United States Patent [19]

Sheffer

[11] Patent Number: 4,643,697

[45] Date of Patent: Feb. 17, 1987

[54] PROMOTIONAL FULL TRAILER ASSEMBLY

[75] Inventor: Phil B. Sheffer, New Oxford, Pa.

[73] Assignee: Merchandising Innovations Co., Inc., Hanover, Pa.

[21] Appl. No.: 836,296

[22] Filed: Mar. 5, 1986

[51] Int. Cl.[4] ..... A63H 33/16

[52] U.S. Cl. ..... 446/488; 446/80

[58] Field of Search ..... 446/488, 88, 79, 80, 446/76, 93; 229/8; 206/457, 44.11

[56] References Cited

U.S. PATENT DOCUMENTS

| | | | |
|---|---|---|---|
| 654,219 | 7/1900 | Bender, Jr. | 446/76 |
| 979,812 | 12/1910 | Warren | 446/79 |
| 1,743,572 | 1/1930 | Schurr | 446/76 X |
| 1,757,243 | 5/1930 | Goldberg | 446/488 |
| 2,028,377 | 1/1936 | Bernasconi | 446/488 X |
| 2,723,488 | 11/1955 | Ringler | 446/79 |

*Primary Examiner*—Mickey Yu

*Attorney, Agent, or Firm*—Daniel J. O'Connor

[57] ABSTRACT

A display article comprising a promotional full trailer assembly which is made entirely of corrugated fiberboard materials. A uniquely engineered series of cuts and score lines permits the article to be shipped in a completely flat or knockdown position. Upon receipt by the retail merchant, consumer or collector, the device may be readily assembled into a highly durable and attractive unit. No separate fasteners or glue of any kind are required for assembly of the unit which may be easily completed even by persons unfamiliar with display assembly techniques. It is contemplated that the device would be suitable for advertising and hobby/collector uses.

1 Claim, 2 Drawing Figures

PROMOTIONAL FULL TRAILER ASSEMBLY

This application is generally related to applicant's copending U.S. patent application Nos. 06/832,631 and 06/836,295 filed Feb. 25, 1986, and Mar. 5, 1986 respectively.

BACKGROUND AND OBJECTS OF THE INVENTION

The invention relates generally to display or promotional items which are manufactured of corrugated fiberboard or other easily workable materials.

It would be highly desirable in the advertising and merchandising arts to mass produce attractive advertising articles which may be shipped in a flat or knockdown position and yet easily assembled by the retail merchant.

Accordingly, it is an object of the present invention to mass produce a promotional or collector's article of inexpensive and easily manufactured materials.

It is a further objective to produce an advertising device which may be shipped in large quantities in a knockdown position and be readily assembled by the users thereof into a highly durable and attractive miniature promotional unit.

It is also an object of the present invention to provide a promotional device which has factory formed sections therein such that the device may be easily assembled without the use of separate fastener elements.

It is a further object to provide a collector's item having factory formed sections therein such that the device will be securely retained in its fully assembled position.

It is a still further object to demonstrate a promotional article which may be fabricated of light-weight materials to reduce shipping and warehousing costs in the distribution of such articles.

Further objects and advantages of the present invention will become apparent as the following description proceeds, and the features of novelty characterizing the invention will be pointed out with particularity in the claims annexed to and forming a part of this specification.

In particular, the invention relates to a miniature full trailer assembly having the trademarks of a particular beverage manufacturer printed thereon.

In production of the promotional device, a flat sheet of corrugated fiberboard material is die cut into a uniquely engineered design which allows the flat sheet to be readily assembled by the user into a durable and highly attractive display item designed to enhance retail sales of a particular product.

PRIOR ART PATENTS

The most relevant prior art patents presently known to the inventor herein are listed as follows: U.S. Pat. No. 1,330,654 issued to Pittman on Feb. 10, 1920; U.S. Pat. No. 537,735 issued to Trufant on Apr. 16, 1895; U.S. Pat. No. 3,261,619 issued to Norgaard on July 19, 1966; U.S. Pat. No. 2,581,100 issued to Hennessy on Jan. 1, 1952; U.S. Pat. No. 953,593 issued to Brown on Mar. 29, 1910; and U.S. Pat. No. 935,865 issued to Seward on Oct. 5, 1909.

With the exception of the Hennessy patent, each of the above references shows a type of foldable display vehicle using wheels as a part of the design. The prior art patents illustrate the relatively complex assembly procedures heretofore required in the art. For example, most prior art teachings require the use of separate fasteners or adhesives to complete the assembly. Such is in direct contrast to the easily assembled structure of the present invention.

The prior art patents further illustrate the relative instability of foldable display articles heretofore used in the art. In contrast, the present invention utilizes a uniquely engineered folding pattern and design which results in an end product which, while requiring no separate fasteners, is highly durable in its intended display use. The present design also incorporates aesthetic qualities heretofore unknown in the assemblable display art.

BRIEF DESCRIPTION OF THE DRAWING FIGURES

FULL DESCRIPTION OF THE PREFERRED EMBODIMENT

Figure 1:
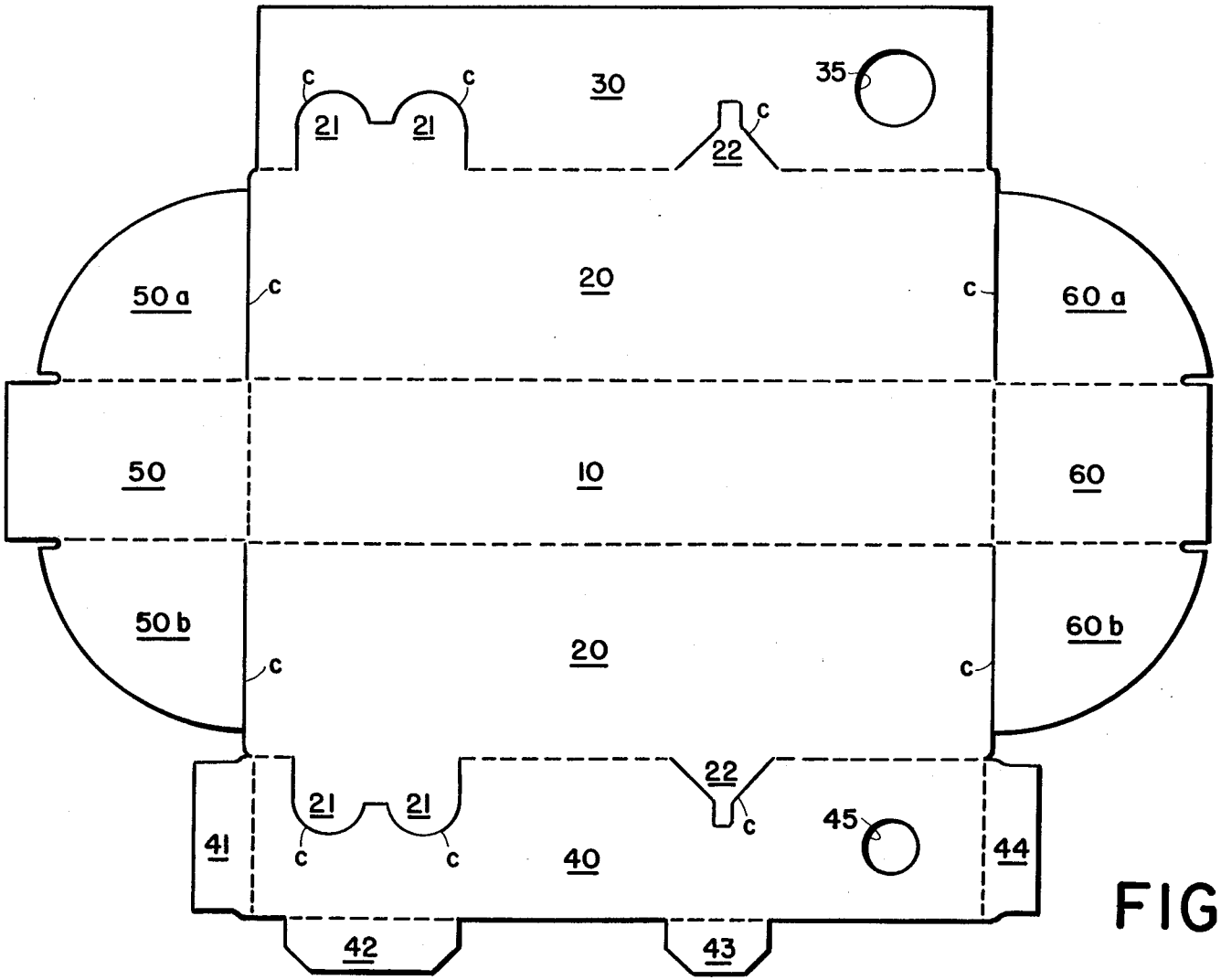
FIG. 1 is a plan view of a flat sheet of corrugated fiberboard having cuts and score lines formed therein in a design which may be folded easily into the shape of a full trailer assembly.

Referring now to FIG. 1, the full trailer assembly is shown in its flat or knockdown position for shipping purposes.

As shown in its flat position, the corrugated fiberboard has factory applied fold lines shown as dashed lines and factory applied cut through portions shown as solid lines and normally designated by the letter C.

The main sections 10, 20, 30, 40, 50 and 60 are shown as defined by dashed score lines therebetween, said score lines allowing a folding of the main sections and attached flaps and tabs relative to each other. The score lines are factory preformed utilizing known steel rule die technology. It should be noted that the solid line sections designated by the letter C represent factory cut through portions to facilitate, for example, the formation of wheel sections 21 and trailer stands 22 upon assembly of the device.

As shown in the flat or knockdown apparatus view of FIG. 1, the one-piece full trailer comprises a rectangular central section 10 which forms the top of the trailer upon assembly, trailer side wall sections 20 attached to both sides of central section 10 via factory applied score lines therebetween, a first end panel section 30 and a second end panel section 40 which overlap to form the trailer bottom wall upon assembly, a rear trailer panel 50 attached to the central section 10 and having flaps formed thereon, and a front trailer wall 60 having flaps formed thereon.

The unique one-piece design may best be illustrated by describing the method of assembly of the full trailer of FIG. 1.

End panel sections 30 and 40 are manually grasped and folded over to such position that section 40 overlies section 30. In this position, tabs 42 and 43 are tucked into the apertures formed by the cut lines shown adjacent numerals 21 and 22 adjacent to end section 30. Once the tabs 42 and 43 are tucked in, an elongated rectangular tube is formed with wheel sections 21 and trailer stand means 22 depending from said elongated rectangular tube on both sides thereof.

Apertures 35 and 45 are formed in the end panels 30 and 40 so as to be aligned upon assembly to allow hitching of the trailer to a display truck if desired.

Flap 41 is then bent inwardly ninety degrees as are flaps 50*a* and 50*b*. The rear trailer panel 50 is then folded upwardly such that its attached flaps 50*a* and 50*b* are internally positioned with respect to the trailer side walls 20.

The assembly of the front portion of the trailer is then accomplished by folding flap 44 inwardly ninety degrees. Flaps 60*a* and 60*b* are also folded inwardly ninety degrees. Trailer front section 60 is then folded upwardly in such manner that its attached flap means 60*a* and 60*b* are positioned internally of the trailer side walls 20.

Figure 2:
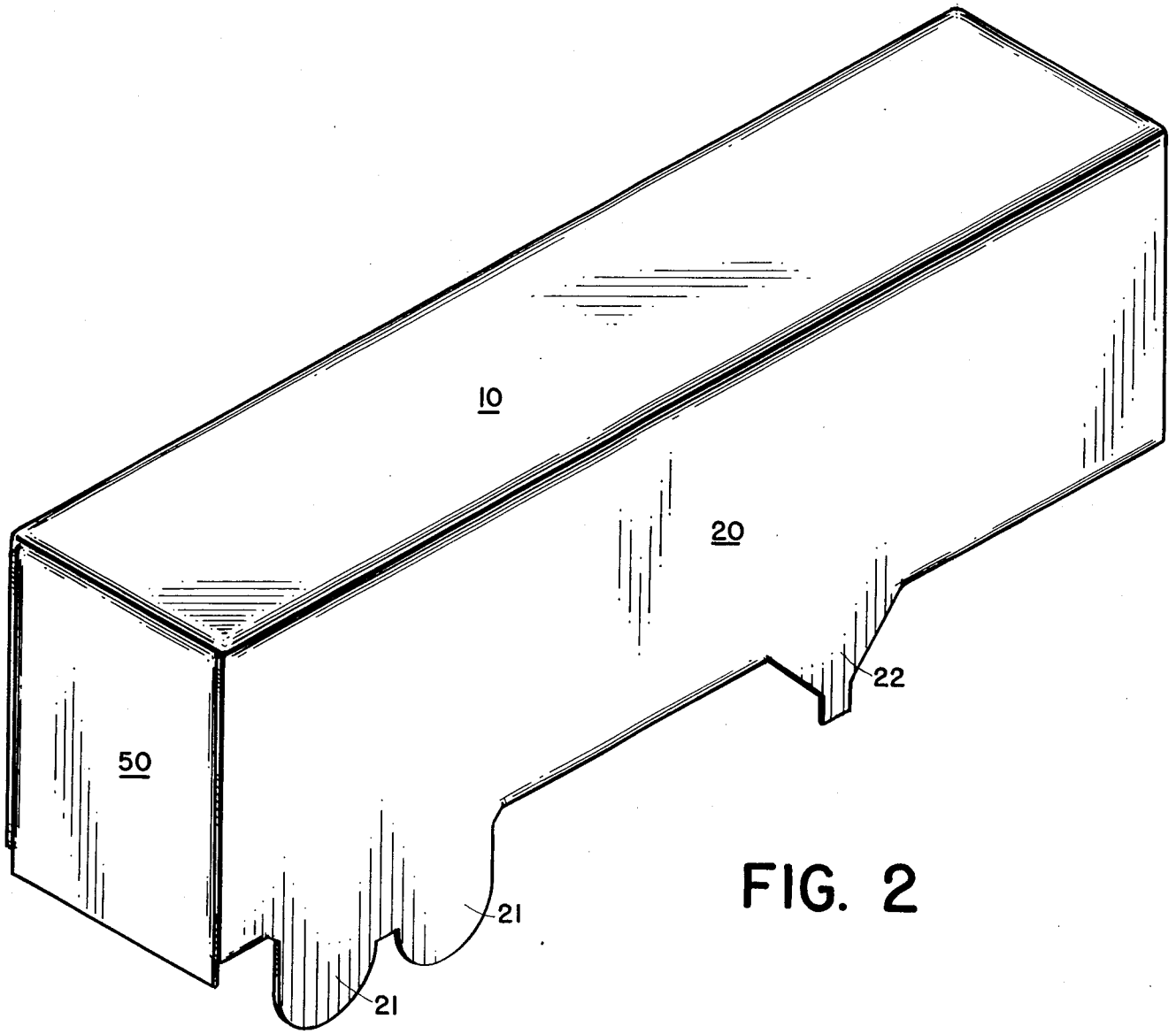
FIG. 2 is a view of the full trailer in its assembled condition for display use.

Suitable printed promotional material, such as an advertisement for a particular product, may be applied to the corrugated material in its flattened position before shipping utilizing known printed technology, i.e. applied to the portions of the apparatus which are visible upon the assembly of FIG. 2.

It will thus be appreciated by those of skill in the art that an easy to assemble yet durable and attractive miniature full trailer promotional aid is achieved by means of the factory cut corrugated fiberboard design.

The one-piece design and flat initial shape yield a product which may be shipped and used in a most efficient and cost-effective manner.

The engineered shapes disclosed are of course critical to both the ease of assembly of the device and the durability and attractiveness of the assembled product.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. A full trailer display assembly means which may be shipped in a flat position and easily assembled by the user thereof comprising:

a single sheet of foldable material having a rectangular central section (10) formed thereon by means of factory applied score lines, a first trailer side wall panel (20) attached to a first lateral edge of said central section (10), a second trailer side wall panel (20) attached to a second lateral edge of said central section (10), wherein both of said trailer side wall panels (20) have wheel sections (21) and trailer stand means (22) formed thereon by means of factory applied cut through portions (C), a first end panel section means (30) attached to said first trailer side wall panel (20), a second end panel section means (40) attached to said second trailer side wall panel (20), means whereby said second end panel section (40) is folded so as to overlie said first end panel section means (30) so as to form a bottom wall of the full trailer assembly, tab means (42, 43) formed on said second end panel section means (40) for retaining the full trailer in an assembled position, rear trailer panel means (50) attached to said rectangular central section (10) at a first end thereof, front trailer wall means (60) attached to said rectangular central section (10) at a second end thereof, wherein said rear trailer panel means (50) has flap means (50*a*, 50*b*) attached thereto, wherein said front trailer wall means (60) has flap means (60*a*, 60*b*) attached thereto, wherein said first and second end panel section means (30,40) have apertures (35,45) formed therein so as to be in alignment upon assembly to be used as a means for attaching the trailer to a display truck, wherein said second end panel section means (40) has flap means (41, 44) formed on opposite ends thereof.

* * * * *